US008157101B2

(12) United States Patent
Arnold et al.

(10) Patent No.: US 8,157,101 B2
(45) Date of Patent: Apr. 17, 2012

(54) MAGNETIC RAKE

(76) Inventors: Patrick D Arnold, San Luis Obispo, CA (US); Bradley G Vernon, Nipomo, CA (US)

( * ) Notice: Subject to any disclaimer, the term of this patent is extended or adjusted under 35 U.S.C. 154(b) by 2237 days.

(21) Appl. No.: 10/699,485

(22) Filed: Oct. 30, 2003

(65) Prior Publication Data

US 2004/0182756 A1 Sep. 23, 2004

Related U.S. Application Data

(60) Provisional application No. 60/423,774, filed on Nov. 4, 2002.

(51) Int. Cl.
*B07B 1/49* (2006.01)

(52) U.S. Cl. ..... 209/417; 209/418; 209/419; 56/342; 294/65.5

(58) Field of Classification Search ..... 209/417, 209/223.1, 419, 418
See application file for complete search history.

(56) References Cited

U.S. PATENT DOCUMENTS 1,927,873 A * 9/1933 Lantz ..... 56/400.15
2,056,906 A * 10/1936 Parkhill ..... 209/217
3,108,426 A * 10/1963 Rugg ..... 56/400.01
3,377,641 A 4/1968 McGregor
3,646,492 A 2/1972 Westerman
4,017,386 A * 4/1977 Barry ..... 209/215
4,087,879 A 5/1978 Spence
4,291,430 A * 9/1981 Hightower ..... 15/142
4,407,038 A 10/1983 Haase
4,741,150 A * 5/1988 Saksun ..... 56/400.21
4,828,690 A * 5/1989 Montez ..... 209/418
4,904,376 A 2/1990 Haase
5,179,825 A * 1/1993 Griffiths et al. ..... 56/400.05
5,395,148 A * 3/1995 Jameson et al. ..... 294/65.5
5,408,818 A * 4/1995 Damron ..... 56/400.04
5,429,402 A * 7/1995 Kennedy ..... 294/65.5
5,927,057 A * 7/1999 Hueber ..... 56/400.06
5,979,957 A * 11/1999 Conrad et al. ..... 294/65.5
6,009,697 A * 1/2000 Billado ..... 56/400.08
6,113,169 A * 9/2000 Gohman et al. ..... 294/65.5
6,142,310 A * 11/2000 Haase et al. ..... 209/215
6,158,792 A 12/2000 Snider
D458,095 S * 6/2002 Hueber ..... D8/13
6,669,024 B2 12/2003 Ottens

* cited by examiner

*Primary Examiner* — Terrell Matthews
(74) *Attorney, Agent, or Firm* — Knobbe, Martens, Olson & Bear, LLP

(57) ABSTRACT

A magnetic raking device for cleaning up of dangerous ferro-metallic particles in and around construction jobsites, parks and playgrounds. A device able to perform the duties of both a conventional rake and a magnetic pick up device in one simple step. A hand operated magnetic raking device comprises a housing with a magnet or magnets placed inside. Teeth extending away from the housing are shaped in a fashion as to provide maximum agitation in surfaces such as grass, gravel and hard packed dirt. Device can be used inverted with the teeth facing up along smooth surfaces to pick up ferro-metallic particles without agitation. A handle is mounted to the housing to provide for easy push/pull use of the device. Length of head and handle may vary according to size and scope of area to be raked and cleaned of ferro-metallic particles such as nails and screws.

12 Claims, 1 Drawing Sheet

MAGNETIC RAKE

REFERENCE TO SEQUENCE LISTING, A TABLE, OR A COMPUTER PROGRAM LISTING COMPACT DISK APPENDIX

Not Applicable

BACKGROUND OF THE INVENTION

Clean up of small ferro-metallic items can be very difficult to do in a cost and time effective manner. In the construction industry providing the customer with a clean and safe environment both during the building phase and upon completion is very important. Screws and nails which are often discarded throughout the day by employees can be very dangerous. This danger poses a problem to vehicles as well as to people on the jobsite.

These items if not immediately picked up become lodged over time in the ground especially after it has been raining and the soil compacts and hardens. The current method and tools which are used, that of a magnetic wand does an insufficient job of picking these items up as it is waved over the ground. Ferro-metallic items also remain buried in ground coverings such as gravel and taller grass and magnetic force alone will not remove these items. It is customary to first rake the property which is to be cleaned with a conventional rake and then to follow up with a magnet pick up device, making it a two step process to do an effective job.

BRIEF SUMMARY OF THE INVENTION

A magnetic rake which will combine the steps of raking the ground and picking up ferro-metallic items at a construction jobsite or other area. This rake will also work well in cleaning places such as parks and playgrounds of dangerous ferro-metallic items such as screws and nails that are on the ground. This rake will simplify and speed up the process of maintaining a clean and safe jobsite work environment, or play area.

Current devices used are either large rolling magnetic sweepers which cannot maneuver very well around shrubbery or smaller magnet wands which just sweep over the ground. As the ferro-metallic items become buried in the ground, one of the best methods to remove them is mechanical agitation followed by magnetic pick up. This device performs both of these actions in one step.

DETAILED DESCRIPTION OF THE INVENTION

Figure 1:
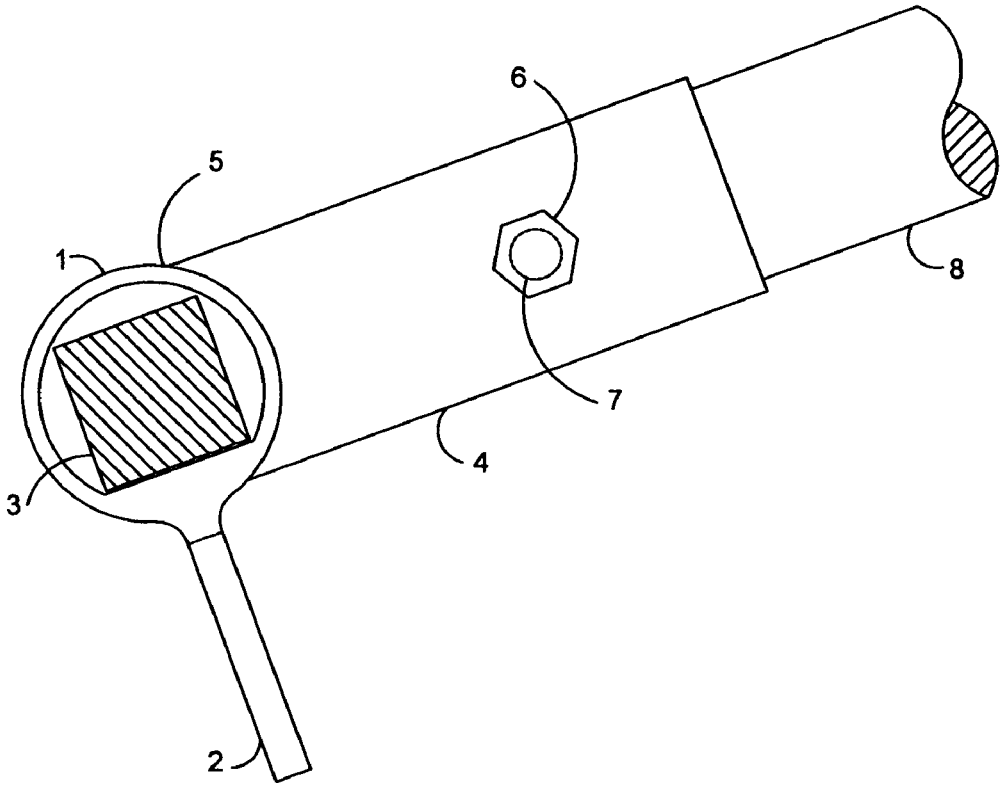
FIG. 1. A side view of the Magnetic Rake showing the rake body extrusion and handle sleeve that is attached to it. Also shown are the internal magnet and the handle which is attached by the handle sleeve.
Figure 2:
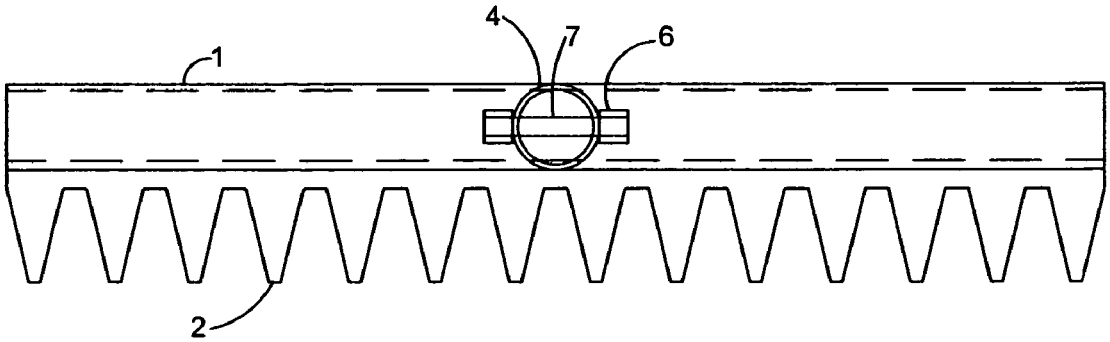
FIG. 2. A plan view of the rake body extrusion showing the profile and relative shape of the teeth as well as a bolting system to hold the handle in place.

The primary design feature behind this magnetic rake is the ability to be used for two functions, raking and magnetic pick up at the same time. The magnetic rake is a hand-operated magnetic raking device that comprises a housing with a magnet or magnets placed inside. Using a non-magnetic alloy such as aluminum, the body 1 is extruded into a convenient length to be used for the particular application. For instance a length of 14 inches is ideal for clean up around existing shrubbery. In some embodiments, the body 1 is cylindrical in shape. Teeth 2 are formed in the extrusion by machining, stamping, cutting, etc. to help with agitation of the soil. A handle sleeve 4 is attached to the extrusion in a process, most likely welding 5 in a fashion to provide strength during use. A handle is mounted to the handle sleeve 4 to provide for easy push/pull use of the magnetic rake. Although an inserted handle 8 is shown, a non removable handle could be welded on as well. Having a removable handle 8 serves a dual purpose, allowing replacement at a later date as well as economical shipping cost. This handle could be attached with a mechanical system 6 through a hole 7 in both the handle sleeve 4 and the handle 8. A magnet 3 is placed inside of the extrusion 1 which will provide the magnetic attraction to the ferro-metallic items to be picked up. A square magnet 3 is shown but a variety of shapes can be used.

This device fills a void in the marketplace for a midsized magnetic pick up tool. The smaller wand type devices are just waved or lightly dragged over the ground in an attempt to pick up ferro-metallic items. Although effective in very tight quarters these devices cannot agitate the soil or other ground cover enough to consistently pick up the dangerous ferro-metallic items. The other option in performing this task is the larger wheeled pick up devices. These are viable options when sweeping larger smooth surfaces clean of ferro-metallic items, but they are unable to get in around shrubbery and other tight areas to retrieve the ferro-metallic items. The magnetic rake submitted here can perform the job of both mentioned items very well. The magnetic rake can be used inverted with the teeth facing up along smooth surfaces to pick up ferro-metallic particles without agitation.

What we claim is:

1. A magnetic rake, comprising:

one or more magnets;

a hollow, unitarily formed, toothed rake body containing said magnets; and a handle attached to said rake body.

2. The magnetic rake of claim 1, wherein said hollow, unitarily formed toothed rake body is formed of a non-magnetic alloy.

3. The magnetic rake of claim 2, wherein said non-magnetic alloy is aluminum.

4. The magnetic rake of claim 1, wherein said handle is detachably connected to said hollow, unitarily formed toothed rake body using a mechanical system.

5. The magnetic rake of claim 1, wherein said handle is permanently attached to said hollow, unitarily formed toothed rake body.

6. A method of collecting ferro-magnetic items from a surface area, said method comprising the acts of:

operating over said surface area a hollow, unitarily formed toothed rake body that contains at least one magnet inside; and allowing ferro-magnetic items from said surface area to collect on said rake body.

7. The method of claim 6, wherein operating said hollow, unitarily formed toothed rake body comprises agitating said surface area with said teeth to loosen said ferro-magnetic items.

8. The method of claim 6, wherein operating said hollow, unitarily formed toothed rake body comprises inverting said rake body such that a toothed portion of said hollow, unitarily formed toothed rake body faces away from said surface area.

9. A system for collecting ferro-metallic items from an area, said system comprising:

means for agitating a ground surface of said area; and means, enclosed within said means for agitating, for attracting ferro-metallic items to said means for agitating using magnetic force.

10. The system of claim 9, wherein said agitating means comprise a hollow, unitarily formed toothed rake body with triangular teeth.

11. The system of claim 9, wherein said agitating means comprise a hollow, unitarily formed toothed rake body with non-triangular teeth.

12. The system of claim 9, wherein said attracting means comprise magnets housed inside a hollow, unitarily formed toothed rake body.

* * * * *